US005148718A

United States Patent [19]

Kakuguchi et al.

[11] Patent Number: 5,148,718

[45] Date of Patent: Sep. 22, 1992

[54] KNOB FOR ROTATING A SHAFT

[75] Inventors: Kazuhiro Kakuguchi; Hirozi Uchimura, both of Kawasaki; Sekizi Nishino, Yokohama, all of Japan

[73] Assignee: Fujitsu Limited, Kawasaki, Japan

[21] Appl. No.: 746,817

[22] Filed: Aug. 15, 1991

Related U.S. Application Data

[63] Continuation of Ser. No. 568,724, Aug. 17, 1990, abandoned.

[30] Foreign Application Priority Data

Aug. 18, 1989 [JP] Japan ..... 1-213460

[51] Int. Cl.[5] ..... G05G 1/10; B25G 3/00

[52] U.S. Cl. ..... 74/553; 403/383

[58] Field of Search ..... 74/553, 557, 543; 403/354, 375, 383, 289

[56] References Cited

U.S. PATENT DOCUMENTS

| | | | |
|---|---|---|---|
| 3,497,847 | 2/1979 | Schapira | 403/383 X |
| 3,498,650 | 3/1970 | Strange | 74/553 |
| 3,503,586 | 3/1970 | Bordes | 74/553 |
| 3,541,882 | 11/1970 | Testa | 74/553 |
| 4,533,074 | 8/1985 | Van Thiel | 403/383 X |
| 4,579,018 | 4/1986 | Ohashi | 74/553 X |
| 4,697,943 | 10/1987 | Ookubo | 74/426 |

FOREIGN PATENT DOCUMENTS

| | | | |
|---|---|---|---|
| 572000 | 3/1959 | Canada | 403/383 |
| 549048 | 11/1942 | United Kingdom | 403/383 |

*Primary Examiner*—Vinh T. Luong
*Attorney, Agent, or Firm*—Staas & Halsey

[57] ABSTRACT

A knob for manually rotating a shaft provided with a flat side partially cut parallel to its axis at its end. The knob is provided with a cylinder portion having an inner hole surface which tightly fits over the end of the shaft having the flat side. The knob further is provided with a slot cut in a flat wall of the cylinder portion along its axial direction.

10 Claims, 3 Drawing Sheets

KNOB FOR ROTATING A SHAFT

This application is a continuation of application Ser. No. 07/568,724, filed Aug. 17, 1990, now abandoned.

BACKGROUND OF THE INVENTION

1. Field of the Invention manually rotating a rotatable shaft such as a rotatable shaft or a roller used to feed a sheet of paper in a printer.

2. Description of the Prior Art

FIG. 1 shows a prior art connection mechanism of a manually operated knob 50 made of a plastic material and employed in a sheet feed apparatus of a printer. The numeral 51 denotes a platen roller; the numeral 52 denotes a rotatable shaft of the platen roller 51; the numeral 53 denotes a grip for manually operating knob 50; and the numeral 54 denotes a cylinder portion coaxially extending from the grip 53. A part of the external surface of rotatable shaft 52 is cut to form a flat surface 56. Cylinder portion 54 has a hole whose cross-section is approximately of the same shape as the cross-section of rotatable shaft 52. A slit 58 extending along the axial direction is provided on the round side of the hole opposite from flat portion 57. Slit 58 permits the cylinder portion 54 to elastically expand to allow insertion of the rotatable shaft 52 therein.

Current printers increasingly have employed a driving method which does not use a clutch between a drive motor and the platen roller. In most cases a stepping motor is used as a sheet-feed motor which is connected via a gear to the platen roller. A stepping motor inherently stays, i.e. locks, at a certain angular position when not being rotationally driven. Therefore, manual rotation of the platen roller 51 to feed a sheet requires a torque to overcome the locking force of the stepping motor. Accordingly, the manual knob must withstand larger torque forces than the conventional knob employed together with a clutch.

In attempting to rotate grip 53 of the prior art structure knob, however, a crack 60 often occurs at a corner 59 between flat portion 57 and round cylindrical portion 54 as shown in FIG. 2. Accordingly, there is a need to provide a durable knob which will withstand cracking by rotational operation.

SUMMARY OF THE INVENTION

It is an object of the present invention, therefore to provide a durable as well as beautifully finished plastic knob for manual rotation of a shaft which is difficult to rotate.

The present invention achieves the above and other objects by providing a plastic knob for manually rotating a shaft having a flat side partially cut parallel to its axis at on of its ends. The knob is provided with a cylinder portion whose inner hole surface is adapted to tightly fit over the end of the shaft having the flat side. The hole of the cylinder portion has a cross-sectional shape which has a flat wall portion opposite a rounded wall portion. A slot is cut in the flat wall portion of the cylinder portion along its axial length thereof. Accordingly, the slot in the flat wall portion not only allows a smooth and tight insertion of the shaft into the hole but also causes a reduction of the stress concentration generated at an inner corner between the flat wall and round wall of the cylinder.

The above-mentioned features and advantages of the present invention, together with other objects and advantages, which will become apparent, will be more fully described hereinafter, with reference being made to the accompanying drawings which form a part hereof, wherein like numerals refer to like parts throughout.

Figure 1:
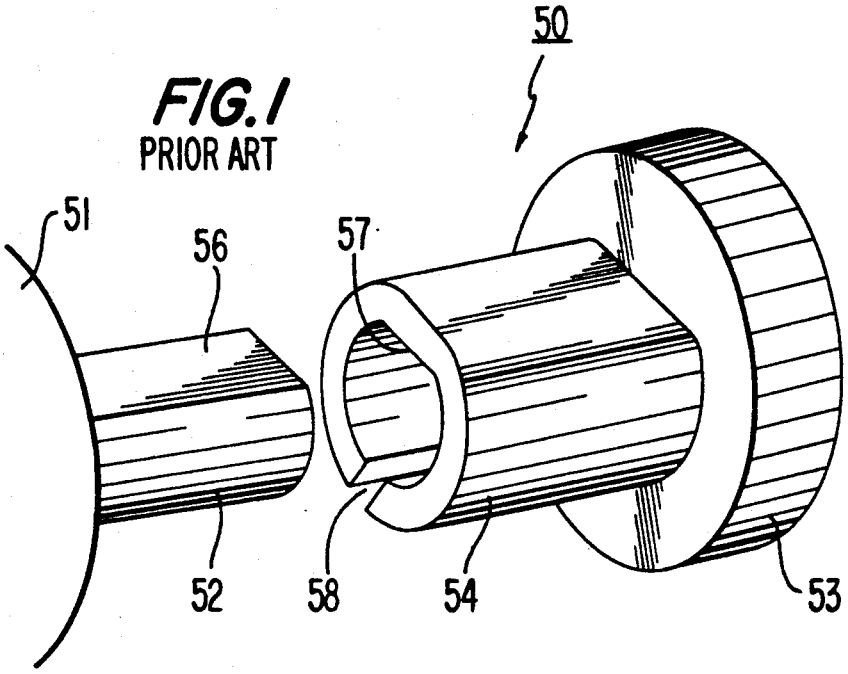
FIG. 1 PRIOR ART
FIG. 1 is a perspective view of a rotatable shaft and a prior art knob to be mounted thereon.
Figure 3:
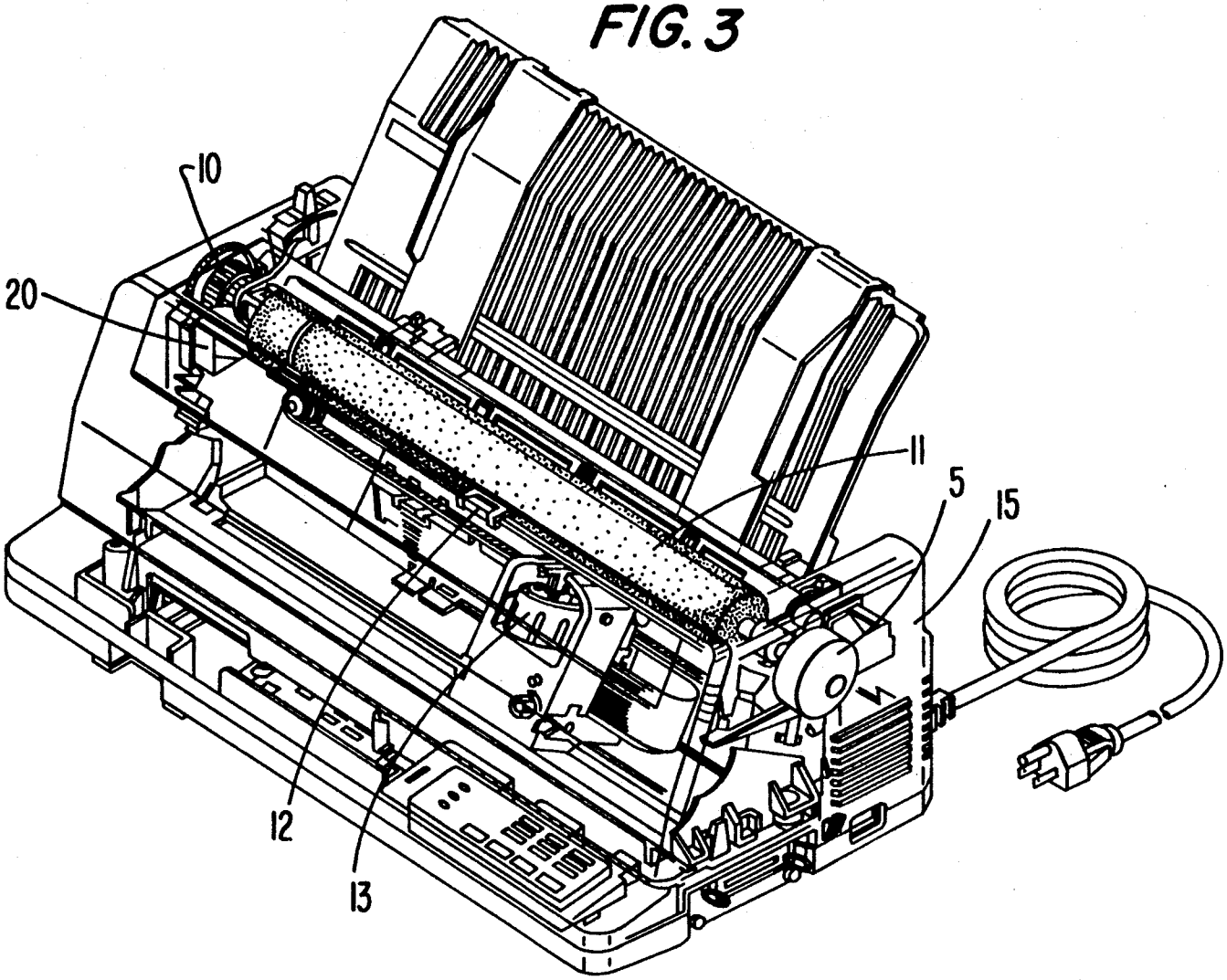
Figure 4:
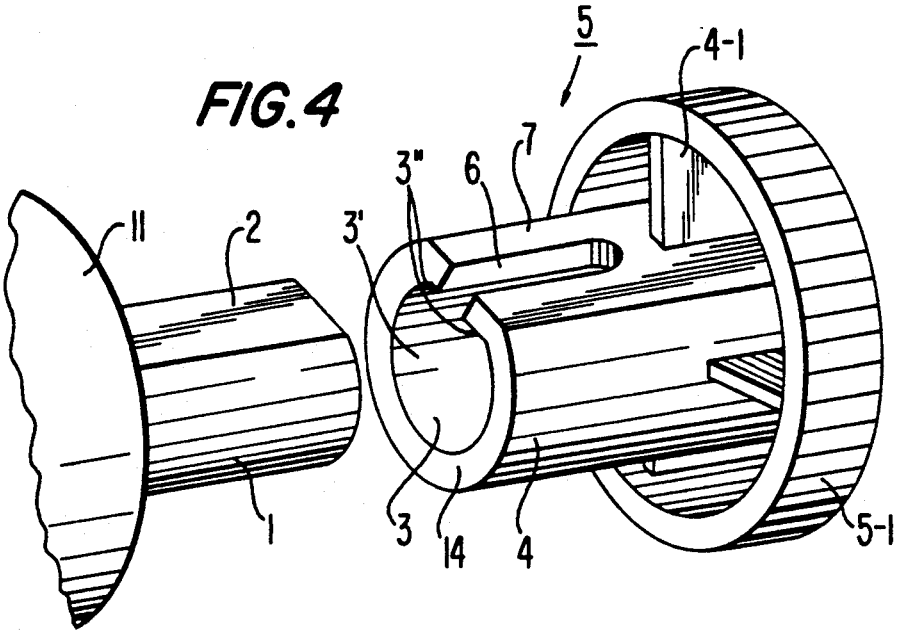
Figure 5:
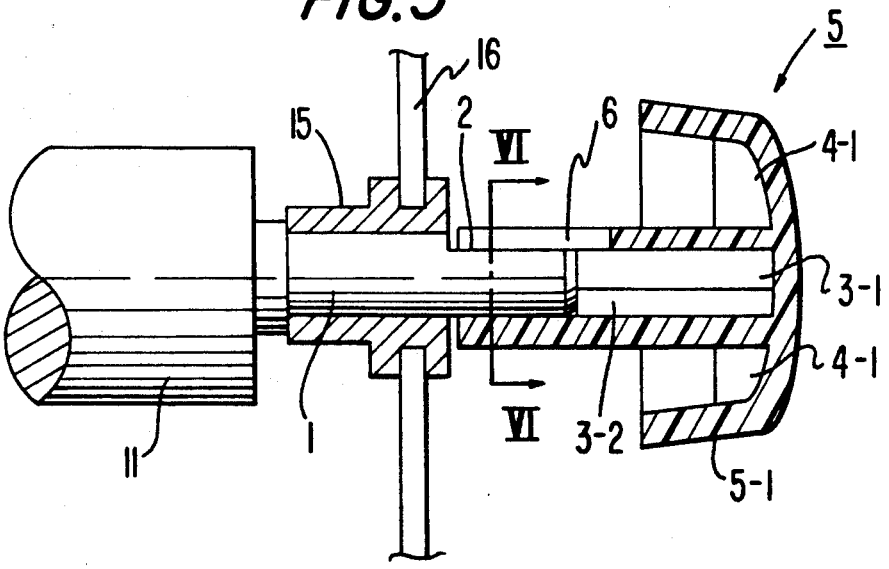
Figure 6:
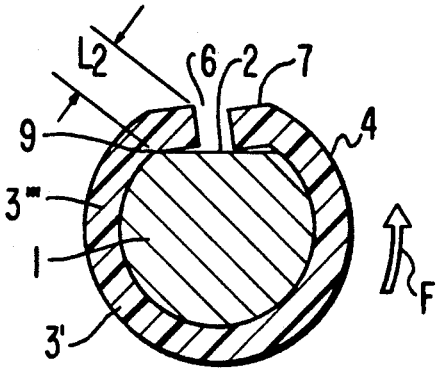

FIG. is a cross-sectional view of the prior art knob of FIG. 1 assembled onto the shaft of FIG. 1 and illustrates a moment generated on the prior art knob;

FIG. 3 is a general configuration of a printer employing a knob according to the present invention;

FIG. 4 is a perspective view of a rotatable shaft and a knob to be mounted thereon according to the present invention;

FIG. 5 is a view showing the knob of FIG. 4 in cross-section and on mounted the shaft of FIG. 4; and FIG. 6 is a sectional view taken along lines VI—VI of FIG. 5 and illustrates a moment generated on the knob of the present invention.

DESCRIPTION OF THE PREFERRED EMBODIMENTS

Shown in FIG. 3 is a general configuration of a printer to which the knob of present invention may be applied. In operation of the printer, a sheet of paper (not shown in the figure) is wrapped around a platen roller 11 and pressed thereto by bail rollers 12. Feeding of the sheet is normally carried out by rotation of the platen roller which is driven by sheet feed motor in the form of a stepping motor 20 via a gear 10 mounted adjacent one end of the roller. Setting of the sheet or fine adjusting of the sheet location is carried out by manual rotation of a knob 5 provided on an end of a rotatable shaft 1 (FIG. 4) opposite from gear 10. A wire-dot type printer-head 13 prints on the paper sheet while moving parallel to the axial direction of platen roller 11. In this specification, the term printer is used broadly and is meant to include a typewriter, or the like.

FIG. 4 shows a perspective view illustrating the connective relation of platen roller 11 and knob 5 for manual operation of the roller. The knob preferably is constructed of a suitable plastic material. The rotatable shaft 1, generally formed of metal, on which the platen roller 11 is mounted, preferably is 10 mm in diameter. A surface at one end of the shaft 1 is cut 2 mm from its outer diameter and 11 mm long from the end so as to form a flat face 2 which is parallel to the shaft axis. The rotatable shaft is chamfered at its end as shown in FIG. 5.

The knob 5 includes an enlarged cylindrical grip 5-1 at its outer end which is adapted to be grasped by an operator. An integral cylinder portion 4 extends coaxially from the grip and has a coaxial hole 3 constituting a hollow interior of the cylindrical portion whose cross-section is approximately the same as the cross-section of the end of rotatable shaft 1 but approximately 0.05 mm smaller in diameter. The hole 3 has a round portion 3' and flat portions 3''. The thickness of cylinder portion 4 is approximately 3.5 mm with the thickness of the walls of the cylindrical portion being substantially uniform. The cylinder portion has a corresponding outer flat portion 7. At the center of flat portion 7 and corresponding hole or hollow interior flat portions 3'' of cylinder portion 4 there is provided a 1.5 mm wide 15 mm long slit 6 extending outwardly from the inner end 14 of the cylinder portion 4 along its axial direction. At the other end of slit 6 toward grip 5-1, the corners of slit 6 are rounded as seen in FIG. 4, in order to avoid stress concentration at that point. Hole or hollow interior 3 further extends beyond the end of slit 6 to an inner wall of grip 5-1 so as to provide a cavity 3-1. Two stopper ribs 3-2 are provided at a point 20.5 mm from the end 14. Stopper ribs 3-2 extend in the axial direction to the deepest end of hole 3, and are 2 mm wide and 1.5 mm high. In order to supplement mechanical connection between grip 5-1 and cylinder portion 4, there are provided 1 mm thick ribs 4-1 which extend radially between the grip and the cylinder portion at four symmetrical angular positions. The ribs each have an axial width of 9 mm.

When the rotatable shaft 1 is inserted into hole 3 of cylinder portion 4 while keeping the flat inner portions 3'' of hole or hollow interior 3 in contact with flat face 2 of rotatable shaft 1, elastic deformation of cylinder portion 4 allows slit 6 to slightly expand. Accordingly, hole or hollow interior 3 compresses, i.e. grasps, the inserted portion of rotatable shaft 1. Therefore, knob 5 can be detachably mounted onto the end of rotatable shaft 1. The chamfered end of rotatable shaft 1 helps its easy insertion into hole or hollow interior 3. Contact of the end of rotatable shaft 1 with stopper ribs 3-2 determines the insertion depth of rotatable shaft 1. Rotatable shaft 1 is shown in FIG. 5 as being supported by bearing 15 on a frame 16 of the printer.

Figure 2:
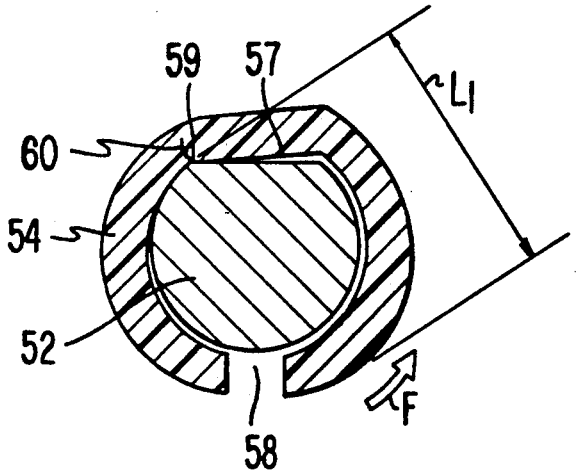
FIG. 2 PRIOR ART

On manually rotating counter-clockwise the grip 4-1 of knob 5 mounted on rotatable shaft 1, a torque denoted by the arrow F is applied onto cylinder portion 4 as shown in FIG. 6, resulting in a stress to cause corner 9 between flat portion 7 and round portion 3' to spread. Under these circumstances, the stress to spread the corner 9 is $F \times L_2$, where $L_2$ denotes the distance from slit 6 to corner 9. According to an analysis with a finite element method, it was calculated that the concentrated stress generated at corner 9 is approximately one half of $F \times L_1$ which equals approximately 2 $Kg/mm^2$ generated at corner 59 in the FIG. 2 prior art knob when the applied torque F is commonly 5 Kg-cm, because $L_2$ is much less than $L_1$. It was also found that the maximum stress, approximately 1.2 $Kg/cm^2$, is generated at an intermediate portion 3''' of round portion 3'.

For the FIG. 1 prior art knob, a material which is mechanically strong but cannot provide a beautiful finish, such as acetal resin (POM), had to be employed. For the knob of the present invention however, polyphenylene oxide (PPO) can be utilized. PPO provides a beautiful finish on the cast surface as well as having a high resistance to chemicals and oils. Acrylonitril-butadiene-styrene resin (ABS), also may be utilized which is less expensive but not as strong as POM.

Though in the above-described preferred embodiment a platen roller is referred to in the sheet feed apparatus, the present invention is not limited thereto. Accordingly, the knob of the present invention may be applicable to any apparatus for manually operating the rotatable shaft, or the like.

The many features and advantages of the invention are apparent from the detailed specification and thus, it is intended by the appended claims to cover all such features and advantages of the system which fall within the true spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

What I claim is:

1. A rotation apparatus comprising:

a rotatable shaft, said shaft having on one end a flat side partially cut parallel to an axial direction thereof and a round side; and a knob mounted on said one end of said shaft; said knob comprising an enlarged gripping portion at one end and having an integral cylinder portion at its other end, said cylinder portion comprising a hollow interior having a solid flat wall portion and a round wall portion whereby the cross-section of said hollow interior is approximately the same as the cross-section of said one end of said shaft to enable said cylinder portion to detachably fit over said one end of said shaft, said hollow interior of said cylinder portion having a diameter slightly smaller than the diameter of said one end of said shaft whereby said cylinder portion snugly fits over said one end of said shaft, said cylinder portion having an inner end and an outer end, said cylinder portion further having a slit cut through said flat wall portion and extending from said inner end along an axial direction of said cylinder portion to thereby reduce the stress concentration generated at an inner corner between said flat wall portion and said round wall portion, said slit having a length which is shorter than the length of said cylinder portion.

2. A rotation apparatus as recited in claim 1, wherein said slit is located centrally of said flat wall of said cylinder portion.

3. A rotation apparatus as recited in claim 1, wherein said slit extends at least beyond said one end of said rotatable shaft inserted in said hollow interior of said cylinder portion.

4. A rotation apparatus as recited in claim 1, wherein said cylinder portion further includes stopper means mounted inside of said hollow interior for contacting said one end of said rotatable shaft to limit the depth of insertion of said rotatable shaft in said hollow interior.

5. A rotation apparatus as recited in claim 1, wherein the thickness of said walls of said cylinder portion are substantially uniform.

6. A rotation apparatus as recited in claim 1, wherein said knob is formed of a plastic material.

7. A rotation apparatus as recited in claim 1, wherein said rotating member is a roller provided in a printer apparatus.

8. A rotation apparatus as recited in claim 7, wherein said roller is a platen roller for feeding a sheet of paper.

9. A rotation apparatus as recited in claim 8, wherein said roller is driven with a sheet feed motor connected to a second end of said rotatable shaft, said second end being opposite from said end having said flat side.

10. A rotation apparatus as recited in claim 9, wherein said sheet feed motor is a stepping motor.

* * * * *

UNITED STATES PATENT AND TRADEMARK OFFICE

CERTIFICATE OF CORRECTION

PATENT NO. : 5,148,718

DATED : September 22, 1992

INVENTOR(S) : KAZUHIRO KAKUGUCHI, HIROZI UCHIMURA and SEKIZI NISHINO

It is certified that error appears in the above-identified patent and that said Letters Patent is hereby corrected as shown below:

Column 1, line 8, "1. Field of ... rotatable" should be

--1. Field of the Invention

The present invention relates to a knob structure for manually rotating a rotatable--.

Column 2, line 10, after "FIG." insert --2--;

line 19, "on mounted" should be --mounted on--.

Signed and Sealed this

Fifth Day of October, 1993

Bruce Lehman

*Attest:*

BRUCE LEHMAN

*Attesting Officer*

*Commissioner of Patents and Trademarks*